United States Patent [19]

Leneveu et al.

[11] 4,279,672

[45] Jul. 21, 1981

[54] FRAGMENTABLE PROPELLANT CONTAINING POLYVINYL NITRATE BINDER

[75] Inventors: Louis J. J. Leneveu; Didier J. Treneules, both of Chateaulin, France

[73] Assignee: Societe Nationale des Poudres et Explosifs, Paris, France

[21] Appl. No.: 964,482

[22] Filed: Nov. 29, 1978

[30] Foreign Application Priority Data

Dec. 15, 1977 [FR] France ..... 77 37901

[51] Int. Cl.[3] ..... C06B 45/10

[52] U.S. Cl. ..... 149/19.8; 102/292; 102/431; 149/2; 149/19.91

[58] Field of Search ..... 149/19.91, 19.8, 2; 102/38 CC, DIG. 1, 100

[56] References Cited

U.S. PATENT DOCUMENTS 3,676,233 7/1972 Netzer et al. ..... 102/DIG. 1

4,023,996 5/1977 Leneveu ..... 149/19.91

*Primary Examiner*—Edward A. Miller

*Attorney, Agent, or Firm*—Bucknam and Archer

[57] ABSTRACT

Unit charge of propellant powder, which can be fragmented and has the ballistic properties of a granular charge. A charge of this type consists of 85 to 97% of grains of propellant powder containing nitrocellulose and 15 to 3% of a thermoplastic energy-producing binder which is in the form of small solid grains, under normal conditions, and has the following composition:

(a) 30 to 60% of polyvinyl nitrate, (b) 70 to 40% of nitrocellulose having a low nitrogen content, or polyvinyl acetate or a mixture of the two, and (c) optionally, a stabilizer.

The use of a solid binder makes it possible to mix the propellant powder with the said binder homogeneously and instantaneously, to introduce precise amounts of the mixture thus obtained into a mould and to simplify the moulding operations.

7 Claims, No Drawings

FRAGMENTABLE PROPELLANT CONTAINING POLYVINYL NITRATE BINDER

The present invention relates to a unit charge of propellant powder, which can be fragmented and consists of grains of powder containing nitrocellulose, which are agglomerated together by means of a thermoplastic, solid energy-producing binder, the said unit charge having the ballistic properties of a granular charge.

Granular charges of powder containing nitrocellulose are commonly used in ammunition for small- and medium-calibre arms.

It has already been proposed to agglomerate the grains of powder containing nitrocellulose into small blocks by compression using a crosslinkable liquid binder which does not produce energy, such as polyurethane, in order to increase the amount of energy-producing material incorporated in a given volume of the charge and, optionally, to omit the socket or cartridge of the ammunition, which is necessary in the case of loose granular charges.

However, the use of a crosslinkable binder presents problems with regard to manufacture and preservation:

it is necessary to introduce, into the mould, a constant mass of gummy pasty material consisting of the mixture of powder and binder, and the slightest weight discrepancy leads to a variation in the ballistic performance obtained with the final block;

the characteristics of dimensional stability of the block prove inadequate under the severe heat conditions under which the block is used and stored; now, the dimensional characteristics have a significant influence on the ballistic properties and, with the crosslinkable binder, the dimensional stability is poor.

Furthermore, in the case where a short compression cycle is desired, the pot-life of the crosslinkable binders at 20° C. is short after the catalysts have been added, and this limits the industrial value.

It has also been proposed to agglomerate the grains of powder containing nitrocellulose by means of nitroglycerine which is a liquid, energy-producing gelatinising agent for nitrocellulose.

Now, it is known that nitroglycerine exhibits a strong tendency to exude from the block, that is to say to migrate from the inside of the block towards the periphery of the latter. Not only does this exudation cause a modification of the composition at certains points in the block, and hence an alteration of the ballistic performance of this block, but also the minute droplets of nitroglycerine exuded at the periphery of this block are likely to explode on the slightest impact. Furthermore, powders containing nitroglycerine are too strong and too fast-burning and they are too erosive and are not suitable for the manufacture of charges which can be fragmented.

The present invention makes it possible to overcome the abovementioned disadvantages. For this purpose, it relates to a unit charge of propellent powder, which can be fragmented and consists of grains of propellant powder containing nitrocellulose, which are agglomerated together by means of a thermoplastic energy-producing binder which is in the form of small solid grains, under normal conditions of temperature and pressure, and has the following composition:

(a) 30 to 60% by weight (relative to the binder) of polyvinyl nitrate, (b) 70 to 40% by weight (relative to the binder) of nitrocellulose having a low nitrogen content of less than 12.8%, or polyvinyl acetate or a mixture of the two, and (c) optionally, a stabiliser. The stabiliser can advantageously be 2-nitrodiphenylamine added in an amount which can reach 3% by weight, relative to the binder.

The amount of energy-producing binder incorporated must be small and between 3 and 15% by weight, and preferably between 5 and 10% by weight, relative to the charge.

Both a good mechanical strength of the block at between −54° C. and +74° C., and a good fragmentation of the charge at the moment of firing, are obtained within this range.

With a binder content of more than 15%, the mechanical strength will be good, but the charge obtained will be poorly fragmented and will start to burn like a compact block and no longer like a loose charge.

With a binder content of less than 3%, the charge will have a poor mechanical strength in the cold.

Optionally, the binder can also contain at least one additive chosen from the group comprising ABS-type (acrylonitrile/butadiene/styrene) polymers, dinitrotoluene, cellulose acetate, phthalates, non-volatile esters, heterocyclic ketones (camphor) or ureas (centralite).

These additives are intended, in particular, to impart good mechanical properties to the charge.

According to a particular embodiment, the binder has the following composition: 40 to 60 parts by weight of highly nitrated polyvinyl nitrate (nitrogen content which can reach 15.4%), 60 to 40 parts by weight of nitrocellulose having a low nitrogen content of 11% to 12.6%, and 2 to 3 parts by weight of 2-nitrodiphenylamine.

Furthermore, the propellant powder is a singlebase powder containing granular nitrocellulose, which is obtained by the "with solvent" process and is called powder "B".

This powder B is preferably a monotubular powder having a potential energy of 870 to 950 calories/g.

Powders having a potential energy of more than 950 calories/g are too fast-burning (the pressure build-up is too rapid) and the maximum pressures measured in the breech are too high for normal arms.

Powders having a potential energy of less than 870 calories/g are not sufficiently fast-burning (the pressure build-up is too low) and the maximum pressures measured in the breech are too low.

Powders containing multitubular grains are difficult to mould by compression in a homogeneous manner, because the grains are too large, and they are of no value, taking account of the mode of disaggregation of the block.

The binder according to the invention offers numerous advantages:

on the one hand, the ingredients of the binder are highly energy-producing and do not cause a lowering of energy, as would a binder which does not produce energy, when the charge is fired; thus, polyvinyl nitrate has a potential energy of 990 calories/g (for a mean molecular weight of 89 and a nitrogen content of 15.4%), nitrocellulose has a potential energy of 940 calories/g (for a nitrogen content of 12.5%) and polyvinyl acetate has a potential energy of −1088 calories/g.

on the other hand, the ingredients of the binder are in the solid state under normal conditions of temperature and pressure and become plastic when hot; it is thus possible to mix the grains of binder in the solid state, homogeneously and instantaneously, with the grains of propellant powder, to introduce precise amounts of the mixture thus obtained into a mould and to avoid the tedious operations which are required in the case of a liquid binder, namely the operations of impregnating the grains of propellant powder with the said liquid binder and drying and stabilising the impregnated grains. Moreover, moulding the charge according to the invention can consist of a simple compression of the propellant powder/binder mixture in a mould, under the action of heat, for a short period of time (1 minute at a temperature of 120° C., under a pressure of 115 kg/cm$^2$) and the charge thus moulded can be withdrawn from the mould immediately after compression; no polymerisation under pressure is necessary.

The present invention also relates to a process for the manufacture of the unit charges of propellant powder, which can be fragmented, which process comprises the following stages:

mixing the grains of powder containing nitrocellulose, in a proportion of 85 to 97% by weight, with a thermoplastic, solid energy-producing binder, as defined above, in a proportion of 15 to 3% by weight, introducing the mixture obtained into a mould, bringing the mould and the said mixture to a temperature at which the binder becomes plastic, preferably to a temperature of 105° to 130° C., compressing the mixture of this temperature, at a pressure of 100 to 150 bars, for a short period of time of about one minute, and withdrawing, immediately after compression, the unit charge thus obtained.

By way of examples of an energy-producing binder, the following compositions can be used in particular:

| Components | Compositions of energy-producing binder Parts by weight | | | | |
|---|---|---|---|---|---|
| | No. 1 | No. 2 | No. 3 | No. 4 | No. 5 |
| Polyvinyl nitrate | 40 | 50 | 50 | 60 | 60 |
| Nitrocellulose containing 11.15% of nitrogen | | 50 | 50 | 40 | 40 |
| containing 12.45% of nitrogen | 60 | | | | |
| 2-Nitrodiphenylamine | 2 | 3 | 3 | 3 | 2.5 |
| ABS resin | 0 | 5 | 10 | 5 | 10 |
| Potential energy calories/g | 860 | 594 | 642 | 605 | 584 |

By way of examples of a propellant powder containing nitrocellulose, the following powders B can be used in particular:

BTu 90 (0.4)=powder B in monotubular grains of potential energy 900 calories/g, of wall thickness 0.4 mm.

BTu 93 (0.4)=powder B in monotubular grains of potential energy 930 calories/g, of wall thickness 0.4 mm.

BTu 93 (0.5)=powder B in monotubular grains of potential energy 930 calories/g, of wall thickness 0.5 mm.

The invention is illustrated by the non-limiting examples which follow:

EXAMPLE 1

The propellant powder used in this example is a granular powder containing nitrocellulose, of the type BTu 93 (0.5) glazed with 1% of centralite.

The energy-producing binder used is composition No. 1 indicated below:

| | |
|---|---|
| polyvinyl nitrate (mean molecular weight 89, nitrogen content 14.7%, potential energy 990 calories/g) | 40 parts by weight |
| nitrocellulose containing 12.5% of nitrogen | 60 parts by weight |
| 2-nitrodiphenylamine | 2 parts by weight |

The mould used is a conventional compression-mould comprising a mould body provided with a cylindrical axial bore forming the mould cavity, and two movable cylindrical punches which are respectively inserted in the upper part and in the lower part of the mould cavity and respectively form the bottom tool and the ejector of the mould. The ejector carries an axial core extended through the mould cavity and inserted in an axial bore provided in the bottom tool. The movement of the punches is controlled by means of jacks. The mould is brought to the desired temperature or cooled by means of a circuit in which a heating or cooling fluid circulates.

The mould is prepared by coating the inside of the mould, the punches and the core with a mould-release agent.

Mixture:

66 g of propellant powder are mixed with 4 g of binder in a mixer (binder content 5.7%).

Moulding:

The mould is heated to 120° C. beforehand and the powder/binder mixture produced above is introduced into the mould cavity.

The said mixture is allowed to heat up to 120° C. and is then compressed at this temperature under a pressure of 800 kg/cm$^2$ for one minute; the charge obtained is then withdrawn from the mould whilst hot. A hollow cylindrical block having a weight of 70 g, a height of 72.5 mm and a diameter of 30 mm, is thus obtained.

This block, when mounted in a metal socket with a shell and using an electric detonator and 0.7 g of an additional powder in the central channel of the block, serving to ignite the block and initiate its fragmentation, gave the following results:

mean maximum pressure (Pm): 2,818 bars, and velocity measured at 25 meters from the muzzle of the arm ($V_{25}$): 850 meters/second.

The fragmentation of the block is current. In the same series of 20 shots, a satisfactory standard deviation of 20 meters/second for the velocity and of 200 bars for the pressure was observed. The mechanical strength is good.

EXAMPLE 2

The propellant powder and the energy-producing binder used are the same as those of Example 1, but the binder content is increased to 10%.

For this purpose, 63 g of propellant powder BTu 93 (0.5), glazed with 1% of centralite, are mixed with 7 g of binder of composition No. 1 and moulding is carried out as described in Example 1. A hollow cylindrical block having a weight of 70 g, a height of 71.8 mm and a diameter of 30 mm, is obtained.

The block, when mounted in a metal socket with a shell and fired using an electric detonator and 2 g of an additional powder in the central channel of the block, gave the following results:

mean maximum pressure: 2,180 bars, and velocity measured at 25 meters from the muzzle of the arm: 840 meters/second.

The fragmentation of the block is correct and the mechanical strength of the latter is good.

EXAMPLE 3

This example is intended to show the influence of the binder content on the ballistic characteristics of the final unit charge; with a binder content of more than 15%, the charge is poorly fragmented and burns like a compact block.

The propellant powder and the energy-producing binder used in this example are the same as those of Example 1, but the binder content is increased to 20%.

The procedure of Example 1 is followed, but a mixture of 56 g of powder BTu 93 (0.5), glazed with 1% of centralite, and 14 g of binder of composition No. 1, is used as the starting material.

A hollow cylindrical block having a weight of 70 g, a height of 72 mm and a diameter of 30 mm, is obtained.

The block, when mounted in a metal socket with a shell and fired using an electric detonator and 2 g of an additional powder in the central channel of the block, gave the following results:

mean maximum pressure: 1,495 bars, and velocity at 25 meters from the muzzle of the arm: 765 meters/second.

The mean maximum pressure is clearly inadequate (less than 1,800 bars) and the fragmentation is poor under the conditions of the experiment.

EXAMPLE 4

This example is intended to show the influence of the potential energy of the propellant powder on the characteristics of the final block. A powder having a potential energy of less than 900 calories/g is not sufficiently fast-burning.

| Propellant powder | Additional powder | Mass of the block | Binder content No. 1 | Height of the block | $V_{25}$ meters/second | Pm bars |
|---|---|---|---|---|---|---|
| BTu 93 (0.4) glazed with 1% of centralite | none | 70 g | 5.5% | 72 mm | 937 | 3,500 |
| BTu 90 (0.4) glazed with 2% of centralite | 1.5 g | 70 g | 5.5% | 72 mm | 825 | 2,640 |
| BTu 85 (0.4) glazed with 3% of centralite | 1.5 g | 70 g | 5.5% | 72 mm | incomplete combustion | |

With the powders B in monotubular grains, of potential energy 930 calories/g [powder BTu 93 (0.4)] and 900 calories/g [powder BTu 90 (0.4)], the fragmentation of the blocks obtained is correct and the mechanical strength of the latter is good. On the other hand, with powder B in monotubular grains, of potential energy 850 calories/g [powder BTu 85 (0.4)], the combustion of the block is incomplete.

We claim:

1. A fragmentable unit charge of propellant powder, which consists of 85 to 97% by weight of grains of propellant powder containing nitrocellulose, which are agglomerated together by means of 15 to 3%, by weight of a thermoplastic, solid energy-producing binder having the following composition:

(a) 30 to 60% by weight, relative to the binder, of polyvinyl nitrate, (b) 70 to 40% by weight, relative to the binder, of nitrocellulose having a low nitrogen content of less than 12.8%, or polyvinyl acetate or a mixture of the two.

2. Unit charge, according to claim 1, wherein the energy-producing binder has the following composition:

(a) 30 to 60% by weight of polyvinyl nitrate, (b) 70 to 40% by weight of nitrocellulose having a nitrogen content of less than 12.8%.

3. Unit charge according to claim 1, wherein the propellant powder is a single-base powder containing granular nitrocellulose, obtained by the "with solvent" process.

4. Unit charge, according to claim 3, wherein the propellant powder is a monotubular powder having a potential energy of 870 to 950 calories/g.

5. A fragmentable unit charge of propellant powder, which consists of 85 to 97% by weight of grains of propellant powder containing nitrocellulose, which are agglomerated together by means of 15 to 3% by weight of a thermoplastic, solid energy-producing binder having the following composition:

(a) 30 to 60% by weight, relative to the binder, of polyvinyl nitrate, (b) 70 to 40% by weight, relative to the binder, of nitrocellulose having a low nitrogen content of less than 12.8%, or polyvinyl acetate or a mixture of the two, and (c) a stabiliser.

6. Unit charge, according to claim 5, wherein the stabiliser is 2-nitrodiphenylamine added in an amount which can reach 3% by weight, relative to the energy-producing binder.

7. Unit charge, according to claim 5, wherein the energy-producing binder has the following composition: 40 to 60 parts by weight of highly nitrated polyvinyl nitrate, 60 to 40 parts by weight of nitrocellulose having a nitrogen content of 11% to 12.6%, and 2 to 3 parts by weight of 2-nitrodiphenylamine.

* * * * *